United States Patent [19]

Van Assendelft

[11] 4,030,248

[45] June 21, 1977

[54] METHOD AND APPARATUS FOR MAKING FILAMENT CABLES

[75] Inventor: Leendert Van Assendelft, Arnhem, Netherlands

[73] Assignee: Akzo N.V., Arnhem, Netherlands

[22] Filed: May 3, 1976

[21] Appl. No.: 682,262

[30] Foreign Application Priority Data

May 12, 1975 Netherlands ..... 7505523
May 12, 1975 Netherlands ..... 7505524

[52] U.S. Cl. ..... 57/9; 57/55; 57/156; 152/359

[51] Int. Cl.[2] ..... D07B 3/00; D02G 3/48

[58] Field of Search ..... 57/34 R, 9, 55, 156, 57/3, 6, 12, 13, 14, 15, 138, 166; 152/359

[56] References Cited

UNITED STATES PATENTS

| | | | |
|---|---|---|---|
| 1,899,559 | 2/1933 | Damon | 57/9 |
| 1,942,218 | 1/1934 | Schmitz | 57/9 |
| 2,811,010 | 10/1957 | Balint | 57/9 |
| 3,641,755 | 2/1972 | Heinen et al. | 57/9 |

*Primary Examiner*—Donald Watkins
*Attorney, Agent, or Firm*—Stevens, Davis, Miller & Mosher

[57] ABSTRACT

A method and apparatus are provided for making a cable particularly well suited for reinforcing elastomeric articles such as belts and tires for motor vehicles. A plurality of metallic filaments are bundled together and helically wound by passing the bundle over a deflecting edge without twisting the filaments around each other. One or more wrapping filaments are then passed over a similar deflecting edge to pre-form the wrapping filament into a helical shape. The wrapping filament is then wound about the bundle while maintaining the hand and pitch of the pre-formed helical shape of the wrapping filament to correspond to those of the filaments of the bundle. The apparatus provided for practicing the method has a horizontal rotor which is driven about a spindle and a plurality of spools independently suspended for feeding filaments to be cabled to the rotor. The rotor has a plurality of filament guide means of which some are adapted to bend a bundle of filaments fed to the rotor to form a helical configuration without winding one filament of the bundle about the other filaments. A spool of wrapping filament is disposed within the rotor and wrapping filament and helically wound core filaments are fed to a cabling device where the wrapping filament is helically wound about the core filaments. A cable prepared in accordance with the method and apparatus provided by this invention is disclosed in my application being Ser. No. 682,264 filed on May 3, 1976, and corresponding to Netherlands Pat. No. 7 505 523 filed May 12, 1975.

10 Claims, 3 Drawing Figures

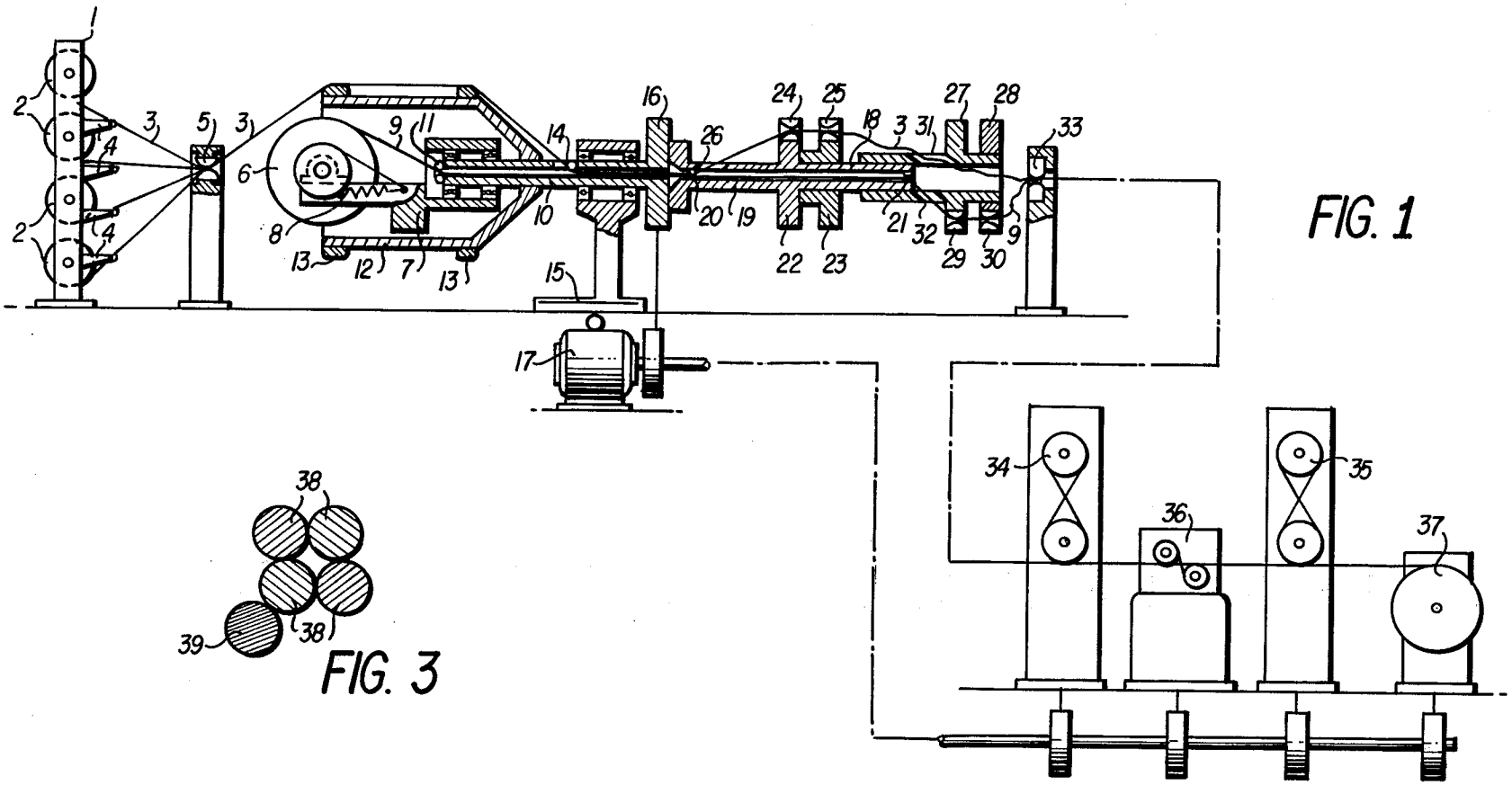
FIG. 1
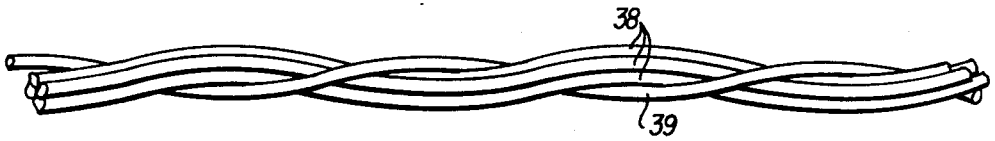
FIG. 2
FIG. 3

METHOD AND APPARATUS FOR MAKING FILAMENT CABLES

This invention relates generally to a method of and an apparatus for making filament cables free from torsional strain and the filament cables thus obtained.

The invention relates to a method of making a filament cable free from torsional strain while in the unloaded state from a number of single metal filaments, more particularly steel filament which are run off from spools and given a permanent pre-deformation by bending them over an edge having a small radius of curvature such that the point of contact of said edge on the filament displaces helically along the periphery thereof, after which the filaments are composed into a cable in a forming device and the cable is subsequently fed to a winding device. The cables thus formed may be used for the reinforcement of elastomeric articles such as pneumatic tires, conveyor belts, transmission belts, etc.

A method of the general type indicated above is known from the Netherlands Pat. No. 6,916,742. The manufacture of steel filament cables from filaments which run off from spools that are placed inside a rotor is described in the patent. While under tension the wires are separately guided through bores in a disk connected to the rotor, the bores being provided with sharp edges at which the wires are so deflected that deformation forces beyond the elastic limit are set up. The resulting helically shaped pre-formed filaments are assembled essentially in this form in a cable-forming sleeve. To reduce its liveliness the cable is subjected to a false-twist treatment before it is fed to the winding device. The radius of curvature of the helices formed in the filaments is dependent on the radius of curvature of the deflecting edge. Accordingly, as the radius of curvature of the deflecting edge becomes smaller the radius of curvature of the filament will decrease provided that the filament is under sufficient tension. The radius of curvature of the filament will also decrease with increasing deflection angle.

The deflection angle is the angle between the center line of the bore and running direction of the filaments to or from the bore. The apparatus known from the aforementioned patent specification comprises two disks provided with guide bores which are arranged axially one behind the other and at some distance from one another with the one disk being somewhat rotated relative to the other.

The radius of curvature of the helix is set by the tensile force and/or the relative rotation of the disks governing the deflection angle.

Although this known method and apparatus make it possible to obtain a cable with favorable mechanical properties, the cable production speed decreases with increasing number of component filaments and with the size of the filament delivery spools being chosen larger for reasons of raising operating efficiency. It has been found that partly because of vibrations, mechanical problems will very much increase with the length and diameter of the rotors, which will lead to a considerable decrease of the permissible rotation speed.

It is therefore an object of this invention to provide an apparatus and method for cabling filaments which is devoid of these disadvantages.

Other objects will become apparent from the following description with reference to the accompanying drawing wherein FIG. 1 is a view partly in longitudinal section and partly in side elevation of an embodiment of the apparatus provided by the invention;

FIG. 2 is a side elevation of a length of cable made with the apparatus of FIG. 1; and FIG. 3 shows the cable of FIG. 2 in cross-section.

According to this invention, the foregoing objects and others are obtained by providing a method and apparatus wherein a first group of filaments is run off a plurality of stationary delivery spools, the filaments are assembled to form a bundle which is guided over a first deflecting edge, one or more other filaments are each guided over one or more other deflecting edges and are wound on the bundle in such a way that the pre-formed helical shape of the wrapping filament or filaments is maintained and has the same hand and the same pitch as the filaments of the bundle. The cable made by this method differs from the cables made by the method of the Netherlands Pat. No. 6,916, 742 in that the filaments of the bundle are not wound about one another but extend along and against one another in such a way that each core filament is in contact with one or more other core filaments, all along the length thereof. On these core filaments are wound one or more wrapping filaments in such a way that they lie against the inside of the helix formed by the core filaments. The cable made by this method is found to display a favorable combination of mechanical properties, such as tensile strength, modulus of elasticity and compression-fatigue resistance and the production costs of the cable are substantially lower than that of a cable made by the method of the Netherlands Pat.No. 6,916,742. This is to be attributed to the fact that a large number of delivery spools are placed stationary outside the rotor and only the spools fo the wrapping filaments need be accommodated inside the rotor, which may consequently be of small dimensions so that it is possible to realize high production speeds and reduced operating costs.

If use is made of a plurality of wrapping filaments, it is preferred that they should be placed parallel to and against one another and be substantially displaced half a pitch length relative to the core filaments. It is recommended that in the case of 5 or more core filaments, use should be made of more than one wrapping filament.

A preferred embodiment is obtained if the method is carried out in such a way that the bundle comprises two to five filaments and one wrapping filament is so laid on the filaments of the bundle that it is shifted half a pitch length relative to the pitch of the bundle filaments.

This cable can be produced at high speed especially because the rotor contains only one spool and may be designed for high rotational speeds because of its small dimensions.

A cable which is particularly suitable for the reinforcement of tires for motor vehicles is obtained if the method is characterized in that all the filaments have the same diameter which is in the range of 0.15 to 0.50 mm and the pitch of the filaments is 25 to 100 times the filament diameter.

The present invention also provides an apparatus for the manufacture of filament cables free from torsional strain by using the method according to the invention, which apparatus comprises a driven horizontal rotor about the spindle of which there are freely and independently suspended one or more rotor spools, and a number of eccentrically positioned filament guide openings which form part of the rotor at least some of which are provided with deflection edges having a small radius of curvature for the deformation of the filaments, and a cable-forming device and a winding device, characterized in that outside the rotor there are placed a number of stationary delivery spools from which the filaments are run off and combined into a bundle which is run through one or more filament guide openings with deflecting edges to the cable forming device while by-passing the rotor spools.

It is preferred that the drives of the rotor and the winding device are mutually adjustable so that with the same apparatus cables having different lay lengths can be formed.

For making cables with one wrapping filament the apparatus is characterized in that it is provided with one rotor spool and the deflecting edge of the wrapping filament is placed diametrically relative to that of the bundle.

This position of the deflecting edge insures that the wrapping filament and the core filaments are assembled accurately at a point which is on the center line of the rotor spindle.

If several wrapping filaments are used, their deflecting edges preferably should be as near together as possible and positioned as near to diametrically opposite the deflecting edge of the bundle as possible. In this way, the wrapping filaments come to lie against one another so that a uniform build-up of the cable is obtained. It is advantageous to use one deflecting edge for the wrapping filaments.

It has been found that at the cable-forming point at the entrance of the cable forming sleeve the cable can be more readily formed if the apparatus is characterized in that the angle at which the wrapping filament runs to the cable-forming sleeve is larger than that for the bundle.

For the accurate setting of the position of the wrappingfilament of filaments on the bundle, it is of importance that the distance between the deflecting edge for the bundle and the point formation of the cable and the distance between the reflecting edge(s) for the wrapping filament(s) and the point of formation are continuously adjustable.

When a cord with one wrapping filament is made, the setting of these distances makes it possible for the wrapping to be shifted half a pitch length relative to the core filaments.

In the embodiment illustrated in FIG. 1 four superimposed delivery spools 2 are mounted in a stand 1. Four filaments 3 can be run off from the spools 2 through an adjustable filament tensioner 4 to a guiding eyelet 5.

A fifth spool 6 for delivering a filament 9 is supported in a cradle 7. A spring-loaded band brake 8 keeps the filament 9 under sufficient tension as it runs off spool 6. The cradle 7 is mounted on a rotor spindle 10 by means of roller bearings in such a way that the center of gravity of cradle 7 and spool 6 is positioned sufficiently below the spindle 10 to prevent the cradle 7 and spool 6 from rotating with the spindle 10. A filament guiding eyelet 11 is located on the spool-side end of the hollow spindle 10. Fixedly secured to the hollow spindle 10 for rotation therewith is a cup-shaped 12 provided with two thread guiding edges 13 which are made of abrasion resistant material. In a lateral opening of the spindle 10 is a filament guiding pin 14. The spindle 10 is supported in a block 15 and is driven through a pulley 16 by a motor 17.

A filament pre-forming unit 18 is mounted on the side of spindle 10 away from the spool 6. The cup-shaped body 12, the spindle 10 and the filament pre-forming unit 18 together form the rotor of the apparatus. The filament pre-forming unit 18 is formed by the hollow cylindrical body 19 provided at opposite ends with guiding eyelets 20 and 21. A disk 22 is fixed on body 19. A disk 23 mounted on body 19 can be shifted and rotated relative to the disk 22 and can be fixed on the body 19. The disks 22 and 23 are provided with guiding eyelets 24 and 25, respectively. The edges of the eyelet 24 are slightly curved whereas one edge of the eyelet 25 is strongly curved.

A disk 27 provided with a hub is mounted rotatable and shiftable on the body 19 on which it can be secured by means of bolts (not shown). Against the disk 27 there is placed a disk 28 which can be rotated relative to the disk 27 and can be secured thereto with means not shown in the drawing. In the disk 27 there are provided filament passages 31 and 32. In the disks 27 and 28 there are guiding eyelets 29 and 30, respectively. The edges of the eyelet 29 are weakly curved, whereas one edge of the eyelet 30 is strongly curved.

All filament guiding members are of an abrasion resistant material.

A cable-forming sleeve 33, roller pairs 34 and 35 driven at an adjustable speed, false-twisting device 36 and winding device 37 are also shown in FIG. 1.

The pitch lengths of the bent filaments 3 and of the filament 9 are determined by the speed of the spindle 10 and the speed at which the filaments are pulled through the apparatus by means of the pair of rollers 34. The amplitudes of the helices of the filaments 3 and the filament 9 are determined by the deflection angle imparted to the filaments 3 on the edge of the guiding eyelet 25 and to the filament 9 on the edge of the guiding eyelet 30. By setting the filament tension and by varying the deflection angles by adjusting the disks 23 and 28 the desired amplitude is set.

In the FIGS. 2 and 3 the numeral 38 indicates a bundle of four filaments 3 which form the helically shaped central bundle of the cable. It can be seen that these filaments are positioned beside one another and are not wound about one another. The equally thick filament 39 (filament 9 of FIG. 1) is helically wound about the bundle and is shifted half a pitch length relative to the pitch of the bundle.

The operation of the apparatus is as follows:

The filaments 3 are bundled in the eyelet 5 and are guided past the spool 6 over the guide rings 13 and via the pin 14 to the center of the spindle 10.

The bundle is fed via the guiding eyelet 20 and the bore 26 through the eyelets 24 and 25 which are somewhat displaced relative to one another, in such a way that the bundle of filaments 3 is sharply deflected over the edges of the guiding eyelet 25 resulting in a permanent helically shaped deformation of the filaments 3. The bundle runs through the passages 31 to the cable-forming point at the entrance of the forming sleeve 33.

The filament 9 from the delivery spool 6 passes through the guiding eyelet 11, and the bore of the spindle 10 to the eyelet 21 and from there via the passage 32 through the guiding eyelets 29 and 30, which are also displaced relative to each other in such a way that the filament 9 is helically deformed as a result of the strong deflection over the edge of the guiding eyelet 30.

The collectively bent filaments 3 are wrapped with the pre-formed filament 9 at the cable-forming point.

The resulting cable passes via the roller pair 34, the false-twisting apparatus 36 and the roller-pair 35 to the winding device 37.

Although the invention is described is detail for the purpose of illustration, it is to be understood that such detail is solely for that purpose and that variations can be made therein by those skilled in the art without departing from the spirit and scope of the invention except as it may be limited by the claims.

I claim:

1. In a process for the manufacture of a filament cable free from torsional strain while in the unloaded state from a plurality of single metal filaments comprises bending the filaments over an edge having a small radius of curvature such that the point of contact of said edge on the filament displaces helically along the periphery thereof to permanently deform the filaments, cabling the filaments in a forming device and winding the cable into a coil, the improvement which comprises withdrawing a first group of filaments from a plurality of stationary delivery spools, assembling the filaments into a bundle and guiding the assembly over a first deflecting edge, guiding one or more wrapping filaments over one or more other deflecting edges to pre-form the wrapping filament or filaments in a helical shape, and winding said wrapping filaments about the bundle while maintaining the hand and pitch of the pre-formed helical shape of the wrapping filament or filaments to correspond to those of the filaments of the bundle.

2. The process of claim 1 wherein the bundle comprises two to five filaments and one wrapping filament is so laid on the filaments of the bundle that it shifted half a pitch length.

3. The process of claim 1 wherein all of the filaments have the same diameter which is in the range of 0.15 to 0.50 mm and the pitch of the filaments is 25 to 100 times the filament diameter.

4. An apparatus for cabling filaments comprising a horizontal rotor having a bore therein;

means for rotating the rotor, a plurality of eccentrically positioned filament guide openings mounted on the rotor, at least some of said guide openings being provided with deflection edges having a small radius of curvature for deforming filaments passing therethrough, a plurality of filament delivery spools for supplying filaments to the rotor, means for bundling the filaments run-off from said spools outside the rotor, means for guiding the bundle into the bore of the rotor and out of the bore, means for guiding the bundle after it emerges from the bore to the cable-forming device, said guide means comprising at least one guide opening having a deflecting edge, a means for guiding at least one wrapping filament into the bore of the rotor separately from the bundle, and means for guiding the said wrapping filament to the cable forming device, whereby the cable-forming device helically winds the wrapping filament about the bundle.

5. Apparatus according to claim 4 having only one rotor spool and wherein the deflecting edge of the wrapping filament is placed diametrically opposite that of the bundle.

6. Apparatus to claim 4 wherein the angle at which the wrapping filament runs to the cable-forming sleeve is larger than that for the bundle.

7. Apparatus according to claim 4 wherein the distance between the deflecting edge for the bundle and the point of formation of the cable and the distance between the reflecting edge for the wrapping filament and said point of formation are continuously adjustable.

8. Elastomeric articles provided with a reinforcing cable manufactured according to the process of claim 1.

9. A vehicle tire provided with a belt built up of reinforcing cable manufactured according to the process of claim 1.

10. An apparatus for cabling filaments comprising a rotatable spindle having a bore extending longitudinally therethrough and an entrance end and a discharge end, means for rotating the spindle, means for bundling a plurality of filaments and guiding the bundle into the bore of the spindle, a second means for guiding one or more filaments into the bore of the spindle separately from said bundle, means for deflecting said bundle at longitudinally spaced points to impart a helical configuration to the bundle with the longitudinal axis of the filaments remaining substantially parallel to each other comprising a tubular member disposed coaxially at the discharge end of the spindle, a first disk attached to the tubular member for rotation therewith having a guiding eyelet with a slightly curved surface for guiding the bundle of filaments, a second disk spaced longitudinally from the first disk having an eyelet coaxial with the first disk and having a surface which is sharply curved for guiding the bundle of filaments, and means for guiding the bundle from the bore of the tubular member to the eyelet in the first disk;

a sleeve member having a longitudinal bore coaxial with the bore in the said tubular member, third and fourth disks secured to the sleeve, an eyelet in the third disk having a curved guiding surface and an eyelet in the fourth disk having a sharply curved surface, said eyelets of the third and fourth disks being coaxial and diametrically opposite the eyelets in the first and second disks, and means for removable securing the third and fourth disks to the sleeve at various points on the circumference of the sleeve, and cabling means disposed adjacent to the discharge end of the sleeve fo receiving said bundle and said one or more filaments and helically winding the latter about the bundle.

* * * * *